US006580892B2

(12) United States Patent
Ohuchi

(10) Patent No.: US 6,580,892 B2
(45) Date of Patent: Jun. 17, 2003

(54) DEVELOPING ROLLER AND IMAGE FORMATION APPARATUS

(75) Inventor: Takao Ohuchi, Tokyo (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 10/020,955

(22) Filed: Dec. 19, 2001

(65) Prior Publication Data

US 2002/0114649 A1 Aug. 22, 2002

(30) Foreign Application Priority Data

Dec. 22, 2000 (JP) ..... 2000-390208

(51) Int. Cl.[7] ..... G03G 15/00; G03G 15/08
(52) U.S. Cl. ..... 399/286; 399/279; 492/56
(58) Field of Search ..... 399/279, 286; 492/18, 49, 53, 56

(56) References Cited

U.S. PATENT DOCUMENTS 5,655,197 A * 8/1997 Okada et al. ..... 399/286 X
5,750,260 A * 5/1998 Ryther ..... 492/56 X
5,763,129 A * 6/1998 Chen et al. ..... 492/56 X
5,893,014 A * 4/1999 Goto et al. ..... 399/286
6,148,170 A * 11/2000 McMindes et al. ..... 492/56 X
6,261,214 B1 * 7/2001 Meguriya ..... 492/56

FOREIGN PATENT DOCUMENTS

JP 62-058383 * 3/1988

* cited by examiner

*Primary Examiner*—Sophia S. Chen
(74) *Attorney, Agent, or Firm*—Sughrue Mion, PLLC

(57) ABSTRACT

A shaft is disclosed, having good electroconductivity and an electroconductive elastic layer which is formed on the outside periphery of the shaft, and which has a thermal conductivity of at least 0.15 W /m·K; and an image formation apparatus equipped with the developing roller. The above developing roller is capable of suppressing temperature rise of the roller surface, thereby preventing a developer from being adhesively fixed to the roller surface, suppressing wear on the roller surface, suppressing the generation of cracking, crazing and the like on the roller end, and thus affording favorable images for a long period of time.

14 Claims, 1 Drawing Sheet

DEVELOPING ROLLER AND IMAGE FORMATION APPARATUS

BACKGROUND OF THE INVENTION

1. Field of the Invention

The present invention relates to a developing roller and an image formation apparatus. More particularly, the present invention is concerned with a developing roller which is used for the purpose of visualizing with a developer, an electrostatic latent image preserved on the surface of a latent image preserving body such as a photosensitive drum, in an image formation apparatus such as an electrophotographic apparatus and an electrostatic recording apparatus, including copying machinery, printers, facsimile apparatuses and the like, and which is capable of affording favorable images for a long period of time for the reason that the temperature rise of the roller surface is suppessed, thereby preventing a developer from being adhesively fixed to the roller surface; and also is concerned with an image formation apparatus equipped with the foregoing developing roller.

2. Description of the Related Arts

With regard to an electrophotographic image formation apparatus such as copying machinery, printers, and the like, there is previously known a pressurized developing method as an image formation method which comprises supplying a unary toner (developer) to a latent image preserving body such as a photosensitive body that preserves an electrostatic latent image, and visualizing the latent image by allowing the toner to adhere to the latent image (refer to U.S. Pat. No. 3,152,012 and U.S. Pat. No. 3,731,146).

The pressurized developing method carries out the image formation by bringing a developing roller that supports a toner into contact with a latent image preserving body (photosensitive body) which preserves an electrostatic latent image, and allowing the toner to adhere to the latent image on the surface of the aforesaid latent image preserving body, whereby the developing roller is required to be constituted of an electroconductive elastic body having both electroconductivity and elasticity.

Specifically in the foregoing pressurized developing method the constitution is such that, for instance, as illustrated in FIG. 2, a developing roller 1 is placed between a toner application roller 5 for toner supplying and a latent image preserving body 6 (photosensitive body) preserving an electrostatic latent image; the developing roller 1, the latent image preserving body 6 ( photosensitive body ) and the toner application roller 5 rotate each in the direction of the arrow in FIG. 2, thereby a toner 7 is supplied onto the surface of the developing roller 1 with the toner application roller 5, and is arranged into a uniform thin film by a layer regulation member 8 (layer forming blade); the developing roller 1 rotates in the state that the toner 7 is so arranged, while being in contact with the latent image preserving body 6; and the toner thus formed into a thin film is allowed to adhere to an latent image on the latent image preserving body 6 from the developing roller 1, whereby the aforesaid latent image is visualized. Symbol 9 in FIG. 2 indicates a transfer portion, where a toner image is transferred to a recording medium such as paper. Symbol 10 in FIG. 2 indicates a cleaning portion, where the cleaning blade 11 removes the toner which remains after the transfer on the surface of the latent image preserving body 6.

In such image formation apparatus by using the pressurized developing method as mentioned above, the developing roller 1 is obliged to rotate, while maintaining the state of close contact with the latent image preserving body 6. For this reason, the constitution of the developing roller 1 is such that as illustrated on the schematic cross-section of FIG. 1, a shaft 2 which consists of an electroconductive material such as a metal is equipped on its outside periphery with an electroconductive elastic layer 3 composed of an electroconductive elastic body which is imparted with electroconductivity by blending an electroconductivity imparting agent in elastic rubber such as silicone rubber, acrylonitrile butadiene rubber, ethylene propylene rubber and polyurethane rubber or foam thereof. In addition, a coating layer 4 which is composed of a resin or the like is installed on the surface of the electroconductive elastic layer 3 in order to control electrostatic property and adhesivity for the toner 7, control the force of friction between the latent image preserving body 6 and the layer regulating member 8 (layer forming blade), or prevent fouling of the latent image preserving body 6 due to the elastic body. With regard to the developing roller as mentioned herein-before, in order to assure a bias voltage which comes to be the driving force for transferring the developer preserved thereon to the latent image preserving body, the electric resistivity of the overall developing roller is made to be $10^4$ to $10^{11}$ Ω, approximately. Further in many cases, for the purpose of facilitating the regulation of the electric resistivity thereof, the specific volume resistance of the electroconductive elastic layer is made low, whereas the specific volume resistance of the coating layer which is composed of a resin is made high. In this case, the specific volume resistance of the coating layer is regulated by incorporating electroconductive powders such as carbon black and a matal oxide in a resin which constitutes the coating layer.

In the case of performing the development of electrostatic latent images by the use of the developing roller such as the above through the pressurized developing method, the surface temperature of the developing roller end portion in particular, is raised by the friction with the toner, toner sealing material or the like, and as a result, there is sometimes caused such phenomenon that the toner is adhesively fixed onto the roller, whereby the roller surface is scraped off. When the hardness of the developing roller surface is increased to enhance the wear resistance as a countermeasure thereaginst, in spite of the enhanced wear resistance of the developing roller itself, in the case of the pressurized developing method, the area of contact between the roller and the latent image preserving body such as a photosensitive body is decreased, thereby making it impossible to carry out favorable development as the case may be. In addition, an excessively high hardness of the developing roller surface often gives rise to a damage to the latent image preserving body. What is more, the excessively high hardness thereof causes a fear of damage to a developer as the case may be because of an overload applied to the developer between the roller and a layer regulating member which is in butt contact with the roller.

SUMMARY OF THE INVENTION

Under such circumstances, a general object of the present invention is to provide a developing roller which is used for the purpose of visualizing with a developer, an electrostatic latent image preserved on the surface of a latent image preserving body such as a photosensitive drum, in an image formation apparatus such as an electrophotographic apparatus and an electrostatic recording apparatus, and which suppesses the temperature rise of the roller surface, so that a developer is prevented from being adhesively fixed to the roller surface, wear on the roller surface is suppressed, and cracking, crazing and the like on the roller end hardly occurs, thus enabling to afford favorable images for a long period of time; and an image formation apparatus equipped with the developing roller. Further objects of the present invention will be made obvious from the content of the specification hereinafter disclosed.

In such circumstances, intensive research and development were accumulated by the present inventors in order to solve the problems and thus achieve the above-mentioned objects. As a result, it has been found that the objects are achievable by a roller which is equipped on the outside periphery of a shaft having good electroconductivity with an electroconductive elastic layer having a thermal conductivity of at least a prescribed value. The present invention has been accomplished by the above-mentioned findings and information.

That is to say, the present invention provides a developing roller which comprises a shaft having good electroconductivity and an electroconductive elastic layer formed on the outside periphery of said shaft, supports a developer on its surface to form thin films thereof and in this state, rotates in contact with or in close vicinity to the surface of a latent image preserving body that preserves an electrostatic image on its surface, and thus supplies the developer to the surface of the latent image preserving body so as to visualize an electrostatic image on the surface of the latent image preserving body, said electroconductive elastic layer having a thermal conductivity of at least 0.15 W/m·K.

Furthermore, the present invention provides an image formation apparatus comprising a latent image preserving body capable of preserving an electrostatic image on the surface thereof and a developing roller which is placed so as to rotate in contact with or in close vicinity to the surface of the latent image preserving body along the surface of the aforesaid latent image preserving body, which supports a developer on its surface to form thin films thereof and which supplies the developer to the surface of the latent image preserving body so as to visualize an electrostatic image on the surface of the latent image preserving body, wherein the above-mentioned developing roller according to the present invention is employed as the developing roller.

DESCRIPTION OF THE PREFERRED EMBODIMENT

Figure 1:
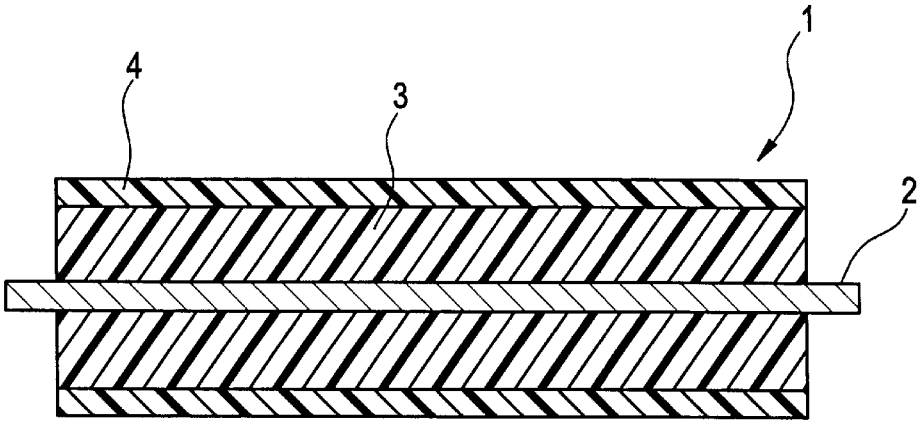
FIG. 1 is a schematic cross-sectional view showing one example of developing roller according to the present invention.

As illustrated in FIG. 1, the developing roller according to the present invention comprises a shaft 2 having favorable electroconductivity and an electroconductive elastic layer 3 formed on the outside periphery of the shaft, and preferably a resin coating layer formed on the surface of the electroconductive elastic layer 3. Any material of construction is usable as the shaft 2, provided that it has favorable electroconductivity. Usually, there is used a metallic shaft such as a core metal composed of a metallic solid body or a metallic cylindrical body made by hollowing out a core metal.

It is indispensable that in the developing roller according to the present invention, the electroconductive elastic layer as mentioned hereinbefore has a thermal conductivity of at least 0.15 W/m·K. The thermal conductivity, when being less than 0.15 W/m·K, results in failure to sufficiently suppress the temperature rise of the roller surface. As a result, there is caused adhesive fixing or solidificaton of a developer, scraping off of the roller surface or cracking of the roller end portion, thereby making it impossible to afford favorable images for a long period of time, and achieve the objects of the present invention. Preferably, the thermal conductivity thereof is at least 0.20 W/m·K.

The thermal conductivity thereof as prescribed above is achievable by properly selecting the kinds and contents of a variety of materials as described hereunder which constitute the electroconductive elastic layer. As the foregoing electroconductive elastic layer, a proper high-polymer elastic body is employed which is imparted with electroconductivity by being incorporated with an electroconductivity imparting agent. The high-polymer elastic body is not specifically limited, but is exemplified by silicone rubber, urethane rubber, polybutadiene based rubber, natural rubber, isoprene rubber, styrene butadiene rubber, nitrile rubber, ethylene propylene rubber, ethylene propylene diene rubber, acrylic rubber, epichlorohydrin rubber and chloroprene rubber. Any of the above-exemplified rubber may be used alone or in combination with at least one other. Among the above-exemplified rubber are preferably usable silicone rubber, urethane rubber, polybutadiene based rubber and isoprene rubber. The high-polymer elastic body may be any of non-foamed and foamed elastic body.

Preferable Examples of the high-polymer elastic body include the mixture of (A) butadiene rubber, (B) isoprene rubber in the form of liquid and (C) silicone rubber.

The preferable content ratio by weight of each of the components expressed in terms of {(A)+(B)}/(C) is set in the range of 95/5 to 5/95. The content ratio departing from the above-mentioned range gives rise to such a disadvantage as imbalance between the desirable physical properties and the manufacturing cost of the rubber composition. The content ratio is more preferably 90/10 to 10/90, particularly preferably 85/15 to 15/85.

It is preferable that the butadiene rubber as the component (A) has a weight average molecular weight Mw of at least 300,000 with a view to assure the physical properties of the rubber. The isoprene rubber in the form of liquid as the component (B) which has a weight average molecular weight Mw of 100,000 or more is undesirable because of its being liable to solidification, thus causing poor dispersing performance at the time of production. Accordingly, the isoprene rubber as the component (B) preferably has a weight average molecular weight Mw of less than 100,000. On the other hand, it is preferable that the silicone rubber as the component (C) has a fundamental molecular structure represented by the general formula:

$$-[SiR_2-O-SiR_2-O-SiR_2-O]n-$$

wherein R is a methyl group, a vinyl group, a phenyl group, a trifluoropropyl group or the like, and n is the number of repetition.

The above-mentioned electroconductivity imparting agent is classified into ionic electroconductivity imparting agent and electronic electroconductivity imparting agent (electroconductive powder). Examples of the former ionic electroconductivity imparting agent include ammonium salts such as perchlorates, chlorates, hydrochlorides, bromates, iodates, borofluorides, sulfates, alkyl sulfates, carboxylates, sulfonates and the like, of any of tetraethyl ammonium, tetrabutyl ammonium, dodecyltrimethyl ammonium such as lauryltrimethyl ammonium, hexadecyltrimethyl ammonium, octadecyltrimethyl ammonium such as stearyltrimethyl ammonium, benzyltrimethyl ammonium, modified aliphatic dimethylethyl ammonium and the like; perchlorates, chlorates, hydrochlorides, bromates, iodates, borofluorides, trifluoromethyl sulfates, sulfonates and the like, of any of alkali metals such as lithium, sodium and potassium, or alkaline earth metals such as calcium and magnesium. Examples of the electronic electroconductivity imparting agent include electroconductive carbon black such as ketchen black and acetylene black; carbon black for rubber such as SAF, ISAF, HAF, FEF, GPF, SRF, FT and MT; oxidation treated carbon black for ink; thermally cracked carbon black; natural graphite; artificial graphite; electroconductive metal oxide such as antimony doped tin oxide, titanium oxide and zinc oxide; and metals such as nickel, copper, silver and germanium each in the form of powder or oxide; and electroconductive polymer such as polyaniline, polypyrrole and polyacetylene. Of the above-cited electronic electroconductivity imparting agent, carbon black for rubber is preferable in view of its inexpensiveness and easiness of controlling electroconductivity in a small amount.

With a view to minimize the amount to be used and at the same time, assure the electroconductivity, it is preferable that the carbon black has a DBP (dibutyl phthalate) oil absorption of preferably at least 100 ml/100 g, particularly preferably at least 120 ml/100 g.

The above-exemplified electroconductivity imparting agent may be used alone or in combination with at least one other. The blending amount thereof is not specifically limited. In the case of the ionic electroconductivity imparting agent, the blending amount thereof is usually 0.01 to 5 parts by weight, preferably 0.05 to 2 parts by weight based on 100 parts by weight of the above-described high-polymer elastic body. In the case of the electronic electroconductivity imparting agent, the blending amount thereof is usually 1 to 50 parts by weight, preferably 5 to 40 parts by weight based on 100 parts by weight thereof.

It is preferable to regulate the specific volume resistance of the electroconductive elastic layer to $10^3$ to $10^{10}$ Ω·cm, particularly to $10^4$ to $10^9$ Ω·cm by regulating the amount of the electroconductivity imparting agent to be added.

In the present invention, for the purpose of enhancing the wear resistance of the roller surface against the developer without excessively increasing the hardness of the roller, it is possible as desired, to incorporate a non-electroconductive filler in the electroconductive elastic layer. The aforesaid non-electroconductive filler is not specifically limited provided that it is non-electroconductive and exhibits the working effect, but can be selected for use from a variety of material. Examples thereof include powder of each of calcium carbonate, clay, talc, silica, alumina, zinc oxide, pumice, barium sulfate, calcium sulfate and the like.

The electroconductive elastic layer may optionally properly be incorporated at need, with any of various well known additives such as fillers, crosslinking agents (vulcanizing agent) and additives for rubber in addition to the foregoing electroconductivity imparting agent and non-electroconductive filler.

It is preferable to set the hardness of the electroconductive elastic member on 30 to 90 degrees, in particular 40 to 75 degrees expressed in terms of Asker C hardness. The Asker C hardness, when exceeding 90 degrees, brings about a fear of failure to conduct favorable image formation due to excessively hardened developing roller and decreased area of contact with the latent image preserving body and besides, often gives rise to damage to a toner and excessively high friction with the latent image preserving body or the layer regulating member, thus causing the fear of defective images such as jitter.

In addition, it is preferable to set the surface roughness of the electroconductive elastic layer on at most 15 μmRz, in particular 3 to 10 μm R z expressed in terms of JIS 10 point average surface roughness. When the average surface roughness exceeds 15 μmRz, it is unfavorably required to increase the thickness of the under-mentioned resin coating layer which forms the surface of the developing roller and as a result, the roller surface is unreasonably hardened to cause damage to a developer and generate fixing of the same onto the latent image preserving body and the layer regulating member, thus bringing about a fear of defective images. On the contrary, when the average surface roughness Rz is unreasonably low, the Rz of the roller surface becomes unreasonably low, and the amount of the developer to be supported is unreasonably decreased, thereby unfavorably deteriorating image density.

The average surface roughness Rz is obtained by measuring the surface roughness on at least 30 places so as not to cause bias, in both the shaft direction and circumferential direction of the roller over a length of 2.4 mm in the circumferential direction at a velocity of 0.3 mm/sec at a cutoff wavelength of 0.8 mm by the use of a surface roughness meter manufactured by Tokyo Seimitsu Co., Ltd. under the trade name "Surfcom 590 A" (the same applies hereinafter).

It is preferable to equip the foregoing developing roller with a resin coating layer which is composed of a crosslinkable resin such as melamine resin, phenolic resin, alkyd resin, fluororesin, polyamide resin, silicone resin or a mixture of any of the exemplified resins and which is placed on the surface of the electroconductive elastic layer to control the charging property and adhesivity, to control the force of friction between the latent image preserving body and the layer regulating member, and to prevent the latent image preserving body from being polluted by the electroconductive elastic layer.

The foregoing resin coating layer has preferably a thickness of 1 to 100 μm. The crosslinkable resin may be incorporated when desired, with any of a variety of additives such as a charge control agent, a lubricant, an electroconductivity imparting agent and an other resin.

There is no specific limitation on the method for forming the resin coating layer. The layer is formed by a method which comprises the steps of preparing a coating solution by dissolving or dispersing the crosslinkable resin, a crosslinking agent and various additives in a proper solvent; applying the resultant coating solution onto the electroconductive elastic layer by a dipping method, roll coater method, doctor blade method, spray method or the like; and thereafter drying and curing the coating at ordinary temperature or an elevated temperature in the range of 50 to 170° C.

Examples of the solvent to be used for preparing the coating solution include alcohol based solvents such as methanol, ethanol, isopropanol and butanol; ketone based solvents such as acetone, methyl ethyl ketone and cyclohexanone; aromatic hydro-carbon based solvents such as toluene and xylene; aliphatic hydrocarbon based solvents such as hexane; alicyclic hydrocarbon based solvents such as cyclohexane; ester based solvents such as ethyl acetate; ether based solvents such as isopropyl ether and tetrahydrofuran; amide based solvents such as dimethylformide; halogenated hydrocarbon based solvents such as chloroform and dichloroethane; and a mixture thereof.

The resin coating layer in the developing roller according to the present invention has a specific volume resistance in the range of preferably $10^7$ to $10^{16}$ Ω·cm, particularly preferably $10^9$ to $10^{14}$ Ω·cm. The developing roller has a specific volume resistance in the range of preferably $10^3$ to $10^{10}$ Ω·cm, particularly preferably $10^4$ to $10^9$ Ω·cm.

The surface roughness of the developing roller on which the resin coating layer is formed is preferably at most 10 μm Rz, in particular 0.3 to 8 μmRz expressed in terms of JIS 10 point average surface roughness. The average surface roughness, when exceeding 10 mRz, unfavorably decreases the charging quantity of the developer or generates reverse charging phenomenon, thus causing fogging of images. On the contrary, when the average surface roughness Rz is unreasonably low, the amount of the developer to be supported is unreasonably decreased, thereby causing a fear of deteriorating image density.

Figure 2:
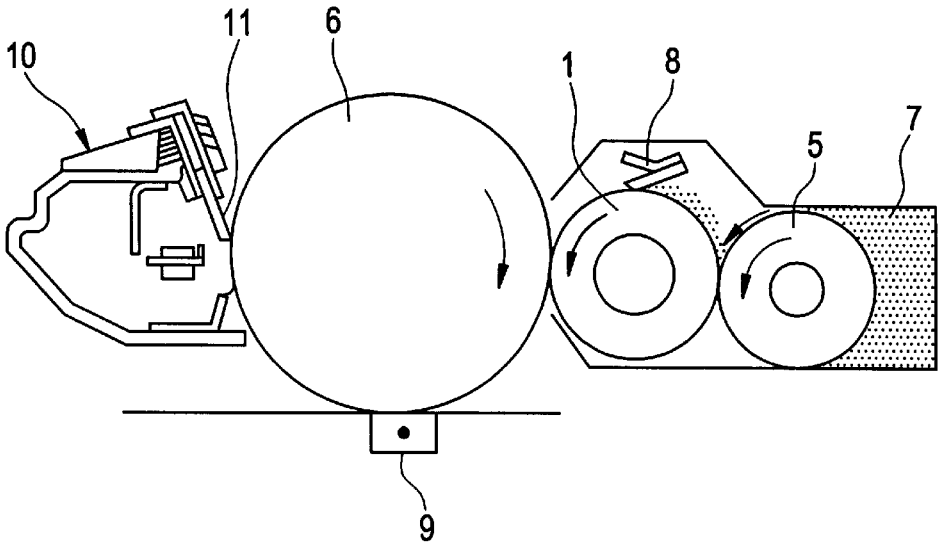
FIG. 2 is a schematic cross-sectional view showing one example of image formation apparatus according to the present invention.

The developing roller according to the present invention is employed in a state of being incorporated in an image formation apparatus such as a developing apparatus in electrophotographic equipment, etc. As illustrated in FIG. 2, for instance, a developing roller 1 according to the present invention is placed between the toner application roller 5 for supplying a toner and a photosensitive drum 6 (latent image preserving body) preserving an electrostatic latent image; and the toner 7 is supported on the toner application roller 5, arranged into uniform thin film by the layer regulating member 8, supplied from the thin film to the photosensitive drum 6 (latent image preserving body) and allowed to adhere to an latent image on the photosensitive drum 6 (latent image preserving body), whereby the latent image is visualized. The detailed description of the image formation apparatus as illustrated in FIG. 2, which has already been given in the foregoing Description of Related Arts, is omitted here.

The image formation apparatus which is equipped with the developing roller is not limited to the apparatus as illustrated in FIG. 2. Any image formation apparatus is usable, provided that the apparatus is such that the developing roller supports a developer on the surface thereof to form thin layer of the developer and in this state, supplies the developer to the surface of the image formation body, while being in contact with or in close vicinity to the image formation body, and thereby forms a visible image on the image formation body. For instance, the image formation apparatus may be such an apparatus in which paper sheets such as paper, OHP paper sheet or the like is used as an image formation body, and the developer which is supported on the developing roller is made to jump over directly onto the image formation body through the holes that are made in a control electrode so as to directly form an image on the paper or OHP paper sheet.

The developer to be supported on the developing roller is preferably a non-magnetic unary developer, but a magnetic unary developer is also usable. For instance, also in the case of carrying out white and black image printing by the use of a magnetic unary developer, it is possible to favorably use the developing roller and the developing apparatus each according to the present invention.

In accordance with the developing roller of the present invention, the temperature rise in the roller surface is suppressed by setting the thermal conductivity of the electroconductive elastic layer which is installed on the outside periphery of the highly electroconductive shaft on at least 0.15 W/m·K. Consequently, it is made possible to prevent the developer from being adhesively fixed to the roller, suppress the wear on the roller surface, inhibit cracking, crazing, etc. of the roller end, and further afford favorable images for a long period of time.

In the following, the present invention will be described in more detail with reference to comparative examples and working examples, which however shall never limit the present invention thereto.

The various characteristics of the developing roller were determined by the method as described hereunder.

(1) Specific volume resistance

Specific volume resistance ρ was calculated by the following formula from the resistance of the electroconductive roller.

$$R=(\rho r_2/Ld)\ ln\ (r_2/r_1)$$

where R: resistance of the developing roller

ρ: specific volume resistance of the electroconductive elastic layer

L: contact length in the direction of the shaft d: nip width $r_1$: radius of the shaft $r_2$: outside radius of the developing roller ln: natural logarithm (2) Resistance of the developing roller Each of specimens was pressed to a copper sheet by applying a load of 4.9 N on both the ends thereof, and a voltage of 100 V was impressed thereto by the use of a resistivity testing meter (manufactured by Advantest Corporation under the trade name R8340A) to measure the resistance thereof.

(3) Thermal conductivity

Thermal conductivity was measured by using a thermal conductivity measuring instrument manufactured by Kyoto Denshi Kogyo Co., Ltd. under the trade name "QTM-500".

(4) Existence of adhesive fixing of toner

After 60 hours of durability test, existence of adhesive fixing of toner was examined on the basis of the following criterion.

○: no adhesive fixing observed

X: adhesive fixing observed (5) Wear on the surface of the developing roller

After 60 hours of durability test, wear on the surface of the developing roller was examined on the basis of the following criterion.

○: no wear observed at all

Δ: somewhat wear observed

X: obvious wear observed from traces likely to have been scraped off at a roller end.

EXAMPLES 1 TO 3 AND COMPARATIVE EXAMPLES 1 & 2

The rubber compositions each having a chemical composition as given in Table 1 were each cast into a mold in which a metallic shaft had been arranged, and were cured under the vulcanization conditions as given in Table 1 to prepare a developing roller composed of a metallic shaft and an electro-conductive elastic layer which was formed on the outer periphery of the shaft, and which had a diameter of 20 mm and a length of 398 mm. Measurements were made of the resistivity for the developing rollers, and of the Asker C hadness, specific volume resistance and thermal conductivity each for the electroconductive elastic layers. The results are given in Table 1.

Subsequently, each of the rollers was mounted on a color laser printer as a developing roller, and was subjected to durability test using a polyester based toner by continuous printing for 60 hours, during which time roller surface temperatures were measured. After the completion of the test, the rollers were examined for the existence of adhesive fixing for toner, and the extent of wear on the surfaces thereof. The results are given in Table 1.

TABLE 1

| | Example | | | Comp/Example | |
|---|---|---|---|---|---|
| | 1 | 2 | 3 | 1 | 2 |
| Rubber Composition (parts by weight) | | | | | |
| Rubber Material | | | | | |
| Rubber A | 75 | 65 | 45 | — | — |
| Rubber B | 25 | 25 | 25 | | |
| Rubber C | — | 10 | 30 | — | — |
| Polyol component | | | | | |
| Polyol A | — | — | — | 100 | — |
| Polyol B | — | — | — | — | 100 |
| Polyol C | — | — | — | — | 9 |
| Polyisocyanate component | | | | | |
| Polyisocyanate A | — | — | — | 13 | — |
| Polyisocyanate B | — | — | — | — | 18 |
| Electroconductivity imparting agent (EIA) | | | | | |
| Ionic EIA | — | — | — | — | 1 |
| Carbon A | — | — | — | 2 | — |
| Carbon B | 15 | 15 | 15 | — | — |
| Crosslinking agent | PO | PO | PO | DBTDL | DBTDL |
| Vulcanizing Conditions | | | | | |
| Temperature (° C.) | 150 | 150 | 150 | 90 | 90 |
| Hour (h) | 1 | 1 | 1 | 12 | 12 |
| Asker C Hardness (degree) | 65 | 61 | 55 | 63 | 78 |
| Specific Volume Resistance 100 V (Ω · cm) | $10^{4.4}$ | $10^{4.2}$ | $10^{4.0}$ | $10^{4.0}$ | $10^{4.5}$ |
| Thermal Conductivity (W/m · K) | 0.19 | 0.22 | 0.27 | 0.09 | 0.13 |
| Roller Surface Temperature (° C.) | 43 | 40 | 35 | 50 | 50 |
| Adhesive Fixing of Toner | ○ | ○ | ○ | X | X |
| Wear on the Surface of Developing Roller | Δ | ○ | ○ | X | X |

Comp/Example: Comparative Example
{Remarks}
(1) Rubber Material
Rubber A: Butadiene rubber having weight average molecular weight (Mw) of 600,000
Rubber B: Isoprene rubber having weight average molecular weight (Mw) of 20,000
Rubber C: Silicone rubber
(2) Polyol Component
Polyol A: Polyalkylene polyol
Polyol B: Polyether polyol
Polyol C: Polyether polyol
(3) Polyisocyanate Ccomponent
Polyisocyanate A: Diphenylmethane diisocyanate
Polyisocyanate B: Diphenylmethane diisocyanate
(4) Electroconductivity imparting agent
Carbon A: Carbon black having DBP oil absorption of 150 milliliter (mL)/100 g
Carbon B: Carbon black having DBP oil absorption of 490 milliliter (mL)/100 g
(5) Crosslinking agent
DBTDL: Dibutyl tin dilaurate, PO: Peroxide

EXAMPLE 4

A phenolic resin coating layer with a thickness of 20 μm was formed on the surface of the roller which had been obtained in Example 3. Subsequently, the roller was mounted on a color laser printer as a developing roller, and was subjected to durability test using a polyester based toner by continuous printing for 60 hours. After the completion of the test, the roller was examined for the existence of adhesive fixing for toner, and the extent of wear on the surfaces thereof. As a result, no adhesive fixing of toner nor wear on the roller surface was observed at all as was the case with Example 3.

What is claimed is:

1. A developing roller comprising:

a shaft having good electroconductivity and an electroconductive elastic layer formed on an outside periphery of said shaft, said shaft, supporting a developer on its surface to form thin films thereof and in this state, rotating in contact with or in close vicinity to a surface of a latent image preserving body that preserves an electrostatic image on its surface, and thus supplying the developer to the surface of the latent image preserving body to visualize an electrostatic image on the surface of the latent image preserving body, wherein said electroconductive elastic layer has a thermal conductivity of at least 0.15 W/ m·K, and the electroconductive elastic layer comprises a mixture of (A) butadiene rubber, (B) liquid isoprene rubber and (C) silicone rubber, and a ratio of said mixture is ((A+B)/C) in a range of 95/5 to 5/95.

2. The developing roller according to claim 1, wherein an elastic body constituting the electroconductive elastic layer is at least one of a non-foamed elastic body and a foamed elastic body, selected from the group consisting of silicone rubber, urethane rubber, polybutadiene based rubber and isoprene rubber.

3. The developing roller according to claim 1, wherein the electroconductive elastic layer has Asker C hardness in a range of 30 to 90 degrees.

4. The developing roller of claim 3, wherein the electroconductive elastic layer has Asker C hardness in a range of 40 to 75 degrees.

5. The developing roller according to claim 1, wherein the electroconductive elastic layer has a specific volume resistance in a range of $10^3$ to $10^{10}$ Ω·cm.

6. The developing roller according to claim 1, wherein a surface of the electroconductive elastic layer has a resin coating layer.

7. The developing roller according to claim 6, wherein a resin constituting the resin coating layer is at least one member selected from a group consisting of melamine resin, phenolic resin, alkyd resin, fluororesin, polyamide resin and silicone resin.

8. The developing roller of claim 1, wherein said electroconductive elastic layer has a thermal conductivity of at least 0.20 W/m·K.

9. The developing roller of claim 1, wherein said electroconductive elastic layer has a surface roughness of less than 15 micrometers RZ.

10. The developing roller of claim 9, wherein said electroconductive elastic layer has a surface roughness of between 3 and 10 micrometers RZ.

11. The developing roller of claim 1, wherein said ratio is 90/10 to 10/90.

12. The developing roller of claim 11, wherein said ratio is 85/15 to 15/85.

13. The developing roller of claim 1, wherein a molecular weight of A is at least 300,000, a molecular weight of B is less than 100,000, and C has a molecular structure represented by the general formula:

$$-[SiR_2-O-SiR_2-O-SiR_2-O]_n-,$$

wherein R is at least one of a methyl group, a vinyl group, a phenyl group, and a trifluoropropyl group and n is a number of repetitions.

14. An image formation apparatus comprising:

a latent image preserving body capable of preserving an electrostatic image on a surface thereof; and a developing roller placed to rotate in contact with or in close vicinity to the surface of the latent image preserving body along the surface of the aforesaid latent image preserving body, which supports a developer on its surface to form thin films thereof and which supplies the developer to the surface of the latent image preserving body so as to visualize an electrostatic image on the surface of the latent image preserving body, wherein the developing roller as set forth in any of claims 1–13 is employed as the developing roller.

* * * * *